United States Patent [19]

Powel et al.

[11] Patent Number: 4,919,359

[45] Date of Patent: Apr. 24, 1990

[54] REUSABLE HIGH SPEED WINDING TUBE

[75] Inventors: Stephen S. Powel, 4305 Tallwood Dr., Greensboro, N.C. 27410; Robert J. Darby, 2715-A Patriot Way, Greensboro, N.C. 27408

[73] Assignees: Stephen S. Powel; Robert J. Darby, both of Greensboro, N.C.

[21] Appl. No.: 321,279

[22] Filed: Mar. 9, 1989

[51] Int. Cl.[5] ..... B65H 75/28

[52] U.S. Cl. ..... 242/125.1; 242/118.32

[58] Field of Search ..... 242/125.1, 125.2, 125.3, 242/125, 118.3, 118.31, 118.32, 18 PW, 118.6, 118.62, 159, 164, 165, 166, 167, 176, 177, 178

[56] References Cited

U.S. PATENT DOCUMENTS

| | | | |
|---|---|---|---|
| 1,991,880 | 2/1935 | Chaffin | 242/125.1 X |
| 2,837,297 | 6/1958 | Moss | 242/118.62 |
| 2,945,638 | 7/1960 | Crawford et al. | 242/118.32 |
| 2,967,026 | 1/1961 | Deventer | 242/118.32 X |
| 3,103,305 | 9/1963 | Heatherly | 242/125.1 X |
| 3,284,023 | 11/1966 | Sowell | 242/125.1 |
| 3,625,451 | 12/1971 | Anderson | 242/125.1 |
| 3,717,291 | 2/1973 | Adams et al. | 242/125.1 |
| 3,794,260 | 2/1974 | Sowell | 242/125.1 |
| 3,971,526 | 7/1976 | Underwood | 242/118.6 |
| 4,401,283 | 8/1983 | Kelley | 242/118.32 |

FOREIGN PATENT DOCUMENTS

| | | |
|---|---|---|
| 2039517 | 2/1972 | Fed. Rep. of Germany . |
| 2463088 | 3/1981 | France . |

*Primary Examiner*—Stanley N. Gilreath
*Attorney, Agent, or Firm*—Rhodes, Coats & Bennett

[57] ABSTRACT

An end cap is releasably mounted on the end of a cylindrical hollow tube to form a reusable cylindrical yarn carrier or winding tube which carries a filamentary or fibrous yarn thereon. When the yarn carrier has been emptied, the end cap is loosened from the hollow tube, and the residual fibers or filaments vacuumed or stripped away.

The hollow tube is formed from a shell of steel, aluminum, lightweight metallic alloys or a polymeric material reinforced with fibers of aramids, carbon, ceramics, glass, or hybrids thereof. The shell is of a prescribed length and a reduced wall thickness in the range of 0.062–0.200 inches. A cylindrical insert of another material is secured to the inner surface of the shell adjacent the marginal end portions thereof to receive the threaded end cap.

9 Claims, 2 Drawing Sheets

REUSABLE HIGH SPEED WINDING TUBE

BACKGROUND AND SUMMARY OF THE PRESENT INVENTION

The present invention is directed to winding tubes primarily used in initially collecting and winding newly spun synthetic yarn as it exits a spinneret. More particularly the invention is directed to a reusable winding tube which will withstand winding speeds of up to 30,000 R.P.M. and above and will also accept a removable end cap on at least one end thereof.

In conventional automatic winding operations, yarn is wound onto a cylindrical laminated paper tube (hereinafter referred to as a "paper tube"). In the past, such laminated paper tubes have been subjected to winding operations at speeds of 3500–4000 meters per minute (approximately 12,000–14,000 R.P.M.) Paper tubes will delaminate at speeds in the range of 6000 meters per minute (approximately 18,000–20,000 R.P.M.) As the yarn spinning speeds increase, winding speeds must also increase. As a result laboratory experiments are now being conducted which require winding speeds of 10,000–12,000 meters per minute (approximately 30,000 R.P.M.) Obviously, new yarn tube constructions are required which will resist the loads imposed at such speeds, particularly tensile stress. Such loads ("hoop stress") have been calculated to be as high as $8.0 \times 10^4$ kilonewtons per square meter. Further, since the winding tubes are intended for use on existing equipment, it is desirable that such new winding tubes maintain the same effective outer diameter and inner diameter, so as to be compatible with existing drive rolls and mounting spindles.

As a further consideration of the present invention and by way of background, one end of such paper tubes includes a peripheral starting groove in the surface thereof adjacent one end (U.S. Pat. No. 3,103,305). The starting groove is often, but not always, divided into two arcuate portions. The greater arcuate portion (approximately 270°) is wider and referred to as the lead-in portion, while the smaller (approximately 90°) arcuate portion (locking portion) is narrower and locks one or more of the initial strands of yarn therein during the initial few turns of the automatic winding operation. Alternatively, when processing fine denier yarns, the starting groove may be a constant cross-section throughout.

The starting groove generally extends completely around the periphery of the yarn carrier, as will be described hereinafter. It is possible, however, that the starting groove extend only partially around the yarn carrier, as long as the arcuate length is sufficient to achieve a reliable latch-up. Therefore, while the ensuing description may be directed to a peripheral starting groove, it should be kept in mind that starting grooves which extend partially around the tube are also envisioned.

These strands are hereinafter and commonly referred to as the "waste bunch." The completed yarn package is removed from the winding machine, and stored or shipped for further processing (e.g., weaving, knitting, or texturizing). The yarn is removed from the yarn carrier during a subsequent operation such as weaving, knitting or texturizing.

When the yarn package is positioned on some type of creel for such further processing, the transfer tail of one package is conventionally severed at or near the waste bunch and tied to the front end of the successive yarn package. After the yarn is removed from the package, the last few strands of the waste bunch remain wedged in the starting groove. Previous attempts to remove the remaining strands have included vacuum stripping, cutting of the strands, or a combination of both. Neither technique is entirely satisfactory. Vacuum stripping simply does not remove all the fibrous or filamentary material. Using a knife to sever the bunch generally results in damage to the surface of the paper tube making it unsuitable for further use. Such damage occurs when the laminates of the paper tube are nicked, cut, or otherwise interrupted. Use of a damaged tube at high speeds then tends to result in delamination.

As a result, conventional paper winding tubes are generally not reusable. There have been some attempts to reuse the tubes at least once by providing a transfer groove at each end of the tube. However, often the paper tube is otherwise damaged during the automatic doffing and emplacement operations which substantially eliminates the reuse of the paper tubes. Conventional paper tubes are relatively expensive (25¢ to $1.00 apiece) and hundreds of thousands or even millions of tubes are used each year by typical yarn manufacturers. Thus the cost of non-reusable yarn carriers is extremely high and the search for a satisfactory reusable yarn tube has been underway for some time.

Merely the replacement of paper tubes with a stronger material such as a polymeric material or aluminum is not an obvious solution. First, polymeric materials alone will not withstand even conventional winding speeds, because of their tendency to develop "creep" and/or tend to expand at such speeds. Secondly, the proper configuration of the transfer groove cannot be molded or machined satisfactorily in the wall of a polymeric or metallic tube. Even if the proper groove configuration could be molded, merely a change of material does not solve the problems created by the necessity to clean the starting bunch groove. It is still not easy to vacuum the fibers from the groove, and utilizing a knife will still damage the surface of the tube so that it cannot be reused.

Some attempts have been made to strengthen the material from which yarn carriers are made. For example, U.S. Pat. No 4,401,283 discloses an injected molded thermoplastic polymeric winding tube reinforced with glass fibers for use on Leesona 929 type winders. See also U.S. Pat. No. 2,945,638 and West German Patent No. 2,039,517. None of these constructions, however, are believed able to withstand winding speeds of 10,000–12,000 mpm, and none show a starting groove or include any means for cleaning it for reuse.

In each of our copending applications, Ser. No. 200,939 filed May 31, 1988, now U.S. Pat. No. 4,834,314, and Ser. No. 258,187 filed Oct. 14, 1988, a winding tube is formed in two separable parts, i.e. the main hollow tube portion and a removable end cap. A peripheral groove of some prescribed shape is formed between the confronting end walls of the end cap and hollow tube to receive the transfer bunch during the automatic winding operation. After the yarn package is emptied the end cap is removed or partially removed from the hollow tube portion, the remaining fibers or filaments vacuumed or stripped away, and the end cap replaced. The yarn carrier is then ready for reuse. A French Patent No. 2,463,088 to Viscosuisse, S. A. shows a somewhat related concept in which a paper tube has a friction fit (apparently plastic) slip-on ring releasably attached to the end thereof. The slip-on ring has resilient fingers that fit inside the paper tube and hold the two components in assembled relation.

While the separable yarn carriers identified hereinabove have desirable characteristics and suggest improvements that might lead to a solution of the groove cleaning problem, they do not address the problem of operating at speeds in the range of 10,000–12,000 mpm. The solution to such a problem is not simply to use a heavier material to achieve strength or a lighter stronger material having thinner walls. The heavier weight material will be detrimental to higher speeds, and may also still expand and burst at such high speeds. While there are stronger, lighter weight materials available, they are prohibitively expensive if produced in tubes of a wall thickness of sufficient magnitude to accomodate a starting groove (approximately 0.100 inch). The answer then appears to lie in a separable yarn carrier in which the hollow tube portion is formed of a shell of relatively light, strong material capable of withstanding winding speeds in the range of 10,000–12,000 mpm, yet includes one or more inserts configured so as to fit existing equipment and receive releasable end caps.

In the broadest aspect of the present invention, there is provided a hollow tube and separable end cap forming a starting groove therebetween. The hollow tube is formed of a thin shell of a material having a sufficiently high tensile strength to withstand loads imposed by spinning speeds in the range of 10,000–12,000 mpm and above and one or more inserts which make the thin-walled tube compatible with conventional winding equipment. The end cap may be formed of metallic or suitable polymeric materials, without reinforcement, as the forces exerted thereon are not as great because they may, at least in part, be transferred to the shell.

In its more specific aspects the reusable winding carrier of the present invention includes a hollow tube having an outer, substantially cylindrical surface adapted to carry a filamentary or fibrous yarn thereon. The end cap includes an outer substantially cylindrical surface having generally the same diameter as the outer surface of the hollow tube. The thin shell is formed of a material such as steel, aluminum, metallic alloys, or fiber reinforced polymeric materials selected from the group containing epoxides, polyesters, and vinylesters. When polymeric materials are selected, they must be reinforced by fibers of glass, carbon, ceramics, aramids, or hybrids thereof. The hollow cylindrical shell is provided with an outside diameter substantially equal to the corresponding diameter of paper tubes, but a wall thickness of 0.062 to 0.200 inches (preferably 0.080 to 0.120 inches). The insert is secured to the inner surface of the shell adjacent the end portion and includes an inner wall having an effective diameter substantially equal to the inner diameter of conventional paper tubes. A portion of the thickness of the insert is reduced and provided with internal threads which receive the externally threaded end cap. It is possible that both ends of the hollow tube may include releasable end caps of the type described to further increase the life expectancy of the winding tube by making either end the start-up end. Alternatively, a reinforcing insert might be emplaced on the end of the shell opposite the end cap 20 which may not be threaded, but which absorbs the wear generated by the winding equipment.

A starting or latching groove encircling or partially encircling the yarn carrier is formed between the confronting walls of the hollow tube and end cap. Is some embodiments, the starting groove is formed with a relatively narrow locking portion extending around a portion preferably (approximately 90°) of the groove and a relatively wider lead-in portion extending around the remaining portion of the groove. The lead-in portion guides the first few turns of the transfer tail into the locking portion. The wider and narrower portions of the starting groove are formed by molding recesses into or chamfering one or both abutting ends of the hollow tube and/or end cap during the fabrication of the components. It should be recognized, however, that starting grooves of different shapes can be formed between the end cap and ring in accordance with the present invention. In some winding operations for finer denier yarns, the starting groove may be of a constant size and shape around the entire periphery.

It is therefore an object of the present invention to provide a reusable yarn carrier which is capable of withstanding winding speeds of at least 10,000 mpm.

It is another object of the present invention to provide a yarn carrier of the type described in which an end cap is releasably attached to the main body portion and forms a starting groove therebetween.

It is another object of the present invention to provide a yarn carrier of the type described in which the hollow tube portion is formed primarily of a steel, aluminum, or fiber filled polymeric material.

Other objects and a fuller understanding of the invention will become apparent upon reading the following detailed description of a preferred embodiment along with the accompanying drawings in which.

DETAILED DESCRIPTION OF PREFERRED EMBODIMENT

Figure 1:
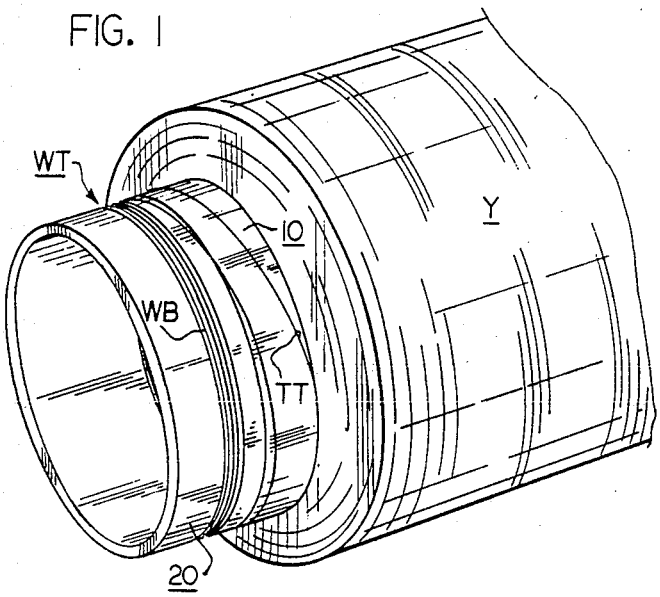
FIG. 1 is a perspective view illustrating a yarn package wound on a winding tube made in accordance with the present invention.

Turning now to the drawings, and particularly to FIG. 1, there is illustrated a yarn package of the type conventionally formed during the initial manufacture of synthetic yarn which exits from a spinneret. As the spinning process has been improved, it now appears that yarn can be spun at speeds of 10,000–12,000 meters per minute. To wind yarn being spun at such speeds on existing yarn tube sizes requires winding speeds in the range of approximately 30,000 R.P.M. and above. The ensuing description is directed toward a composite winding tube that will first of all withstand such winding speeds. A second aspect of the present invention that will be described is the manner in which such tubes may be adapted for cleaning and reuse.

The yarn package includes a winding tube WT about which thousands of turns of yarn Y are wrapped. The winding tube WT is formed of at least two parts, i.e. the cylindrical hollow tube 10 and at least one end cap 20. A latching or starting groove extending around the periphery is formed between the hollow tube 10 and the releasable end cap 20. As the yarn package is initially formed, a relatively small number of turns of the yarn are guided into the starting groove where they are locked and form the waste bunch WB. The length of yarn extending between the waste bunch and the yarn package Y is referred to hereinafter as the transfer tail TT.

At the outset of the winding operation, an empty winding tube WT is initially emplaced on the spindle (not shown) of a winding machine ready to have yarn wound thereupon. Rotation of the yarn tube is then commenced by some type of drive roll(s) which engage either one or both end portions of the winding tube, depending on the type of winding apparatus used. At the outset of the automatic winding operation of polyester or any other extruded or spun synthetic yarn thereon, a vacuum hose is temporarily accepting the polyester or other polymeric yarn filament being extruded through the spinneret while awaiting the emplacement and start-up of the winding tube. The vacuum hose is then held near the bottom periphery of the winding tube WT while a hand-held wire instrument is used by the operator to lift or move the yarn filament into engagement with the starting groove. As the yarn is guided into the starting groove, it latches up and breaks from the remainder of the yarn being carried away by the vacuum hose. After the break occurs, rotation of the winding tube causes a few turns to form a waste bunch in the peripheral groove 42. Formation of the waste bunch functions to lock the leading end of the yarn tail as well as to maintain the "off-spec" yarn out of the yarn package while the speed of the yarn being extruded and the rotation of the tube is stabilized. After the waste bunch is completed, the winder goes into a normal wind cycle with the yarn being wrapped around the main body of the hollow tube 10.

In use the yarn package is placed on a creel upstream of a loom, knitting machine, or texturing machine in a stationary position and yarn is pulled off the "take-off" end. The operator snips or severs the transfer tail at the waste bunch and ties it to the lead end of the succeeding yarn package to be used. Once the yarn package is emptied, the winding tube WT must either be discarded, or else the groove in which the waste bunch is wound must be cleaned of remaining fibers. While in conventional winding techniques, for all practical purposes the groove of a paper tube cannot be cleaned, one of the aspects of the present invention makes such cleaning possible and even facilitated.

Thus, according to the above described second aspect of the present invention, once the winding tube WT is emptied, the end cap 20 is loosened from the hollow tube 10, whereupon the remaining fragments, filaments, or fibers of the waste bunch may be easily vacuumed or stripped away. The hollow tube 10 and end cap 20 are then tightened, and the yarn carrier WT is ready for reuse.

Figure 2:
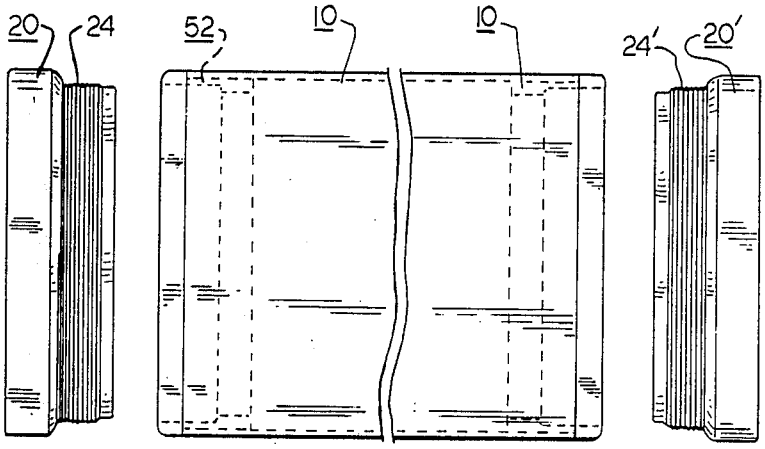
FIG. 2 is a side view, with parts broken away, illustrating the winding tube of the present invention.

Turning now to FIG. 2 there is illustrated an empty winding tube WT. Threads on the inside of the end portion of the hollow cylindrical tube 10 provide for the attachment of a releasable end cap 20 on at least one end thereof. The periphery of tube 10 and end cap 20 are substantially coextensive. As illustrated in FIG. 2, a second end cap 20 may be releasably attached to the opposite end, in which case the life expectancy of the tube may be extended, and either end of the tube may serve to accumulate the waste bunch. However, it is felt that a quite satisfactory, long lasting winding tube WT can be fabricated which includes the end cap 20 on one end alone.

The cylindrical hollow tube 10 lies at the heart of the present invention. In order to achieve winding speeds that are double those known heretofore, the cylindrical hollow tube itself must be strengthened more than it may first appear without making the tube prohibitively expensive. It has been determined that the tensile stress increases as the square of the increase in winding speed. Additionally, since the outer diameter of the winding tube cannot be increased to an appreciable extent, the tube cannot be made thicker, because it is also necessary to maintain the same effective inner diameter. The goal in the present invention is to provide a thin shell for the winding tube that has a significantly thinner wall, yet is significantly stronger. Yet provision must be made for the starting groove. Therefore, and in accordance with the present invention, the hollow tube 10 is formed of a thin cylindrical shell 12 which forms the length of the hollow tube 10 and an insert 50 secured to the inner surface of each marginal end of said hollow tube. Each insert 50 is relatively short (1–2 inches). While the shell 12 forms the winding surface, the inserts 50 engage the spindle and receive the end cap(s) 20,20' and securing them to the hollow tube 10.

The shell 12 is formed of a reduced thickness preferably (0.08–0.12 inches is exemplary, but could vary from 0.062–0.200). The material of shell 12 is important and is either a rigid, substantially incompressible polymeric material such as epoxides, polyesters and vinylesters reinforced with fibers of glass, aramid, carbon, ceramic, or hybrids thereof, or alternatively may be steel, aluminum, or other lightweight metallic alloys exhibiting the tensile and compressive strength characteristics of steel or aluminum. The fiber reinforced shells 12 are preferably fabricated by a conventional laid up or wound process, as a portion of the strength comes from the wound fiber construction.

A shell 12 is formed from such materials exhibits sufficient tensile strength to resist the loads imposed by surface winding speeds in the range of 10,000–12,000 mpm and above. When configured as hereindescribed as a thin shell 12 (0.062–0.200 inches) and when combined with inserts 50, the resulting construction assembly minimizes the use of expensive materials in the tube body while maintaining compatability with existing equipment.

Figure 3:
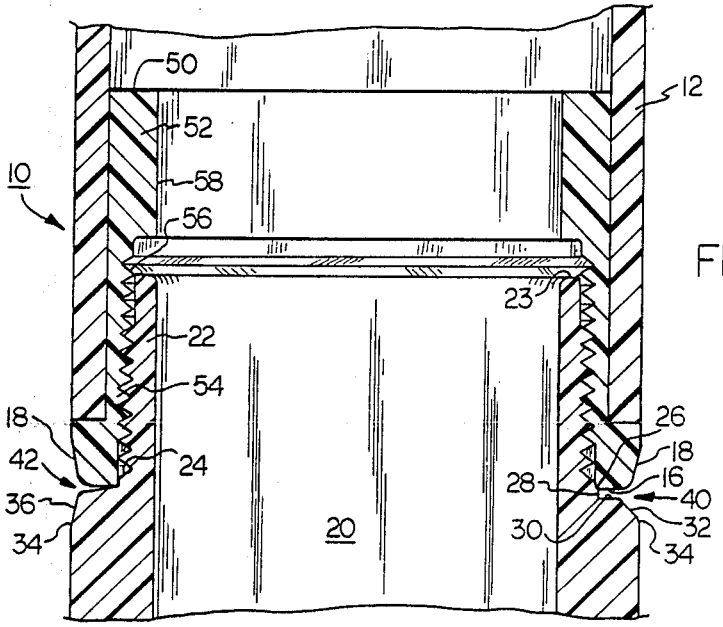
FIG. 3 is an enlarged sectional view with parts broken away, taken diametrically through one end of the yarn carrier of FIG. 2.

The insert 50 illustrated best in FIG. 3 is formed of any suitable rigid, substantially incompressible polymeric material such as polyvinylchloride, polycarbonate, PBT, ABS, polytetraphthate, glass-filled polymers, and carbon-filled polymers, but does not necessarily need to be reinforced with fibers. A body portion 52 includes a thread bearing extension 54 of reduced thickness provided with internal threads 56. The inner surface or wall 58 of body portion 52 is of the same diameter as the effective inner diameter of conventional tubes, so that the tube 10 will be received on conventional winding equipment. When used with certain types of winding equipment, the inner wall 58 might have to be extended axially or exhibit a slightly different configuration to mount on existing mandrels, which vary among manufacturers. However, the important consideration is that the insert 50 have an inner wall or shape consistent with the mandrel of the winding equipment for which the winding tube is intended. The insert 50 is important, because (1) the thin shell alone could not form the starting groove with the end cap, and (2) it would be difficult to thread the inner surface of the thin shell and particularly thin shells of fiber reinforced polymers of the type contemplated. Therefore, insert 50 performs the functions of permitting the use of extremely thin wall shells, mounting the winding tube WT on the winding apparatus, and seating the threaded end cap(s) 20,20'. Each end of the shell 12 may be fitted with identical inserts 50, so that end caps 20,20' may be seated on both ends and so that either end will receive an end cap. If identical inserts are not used, an insert having the proper inside diameter and/or configuration to mount on the intended mandrels should be substituted for insert 50.

Figure 4:
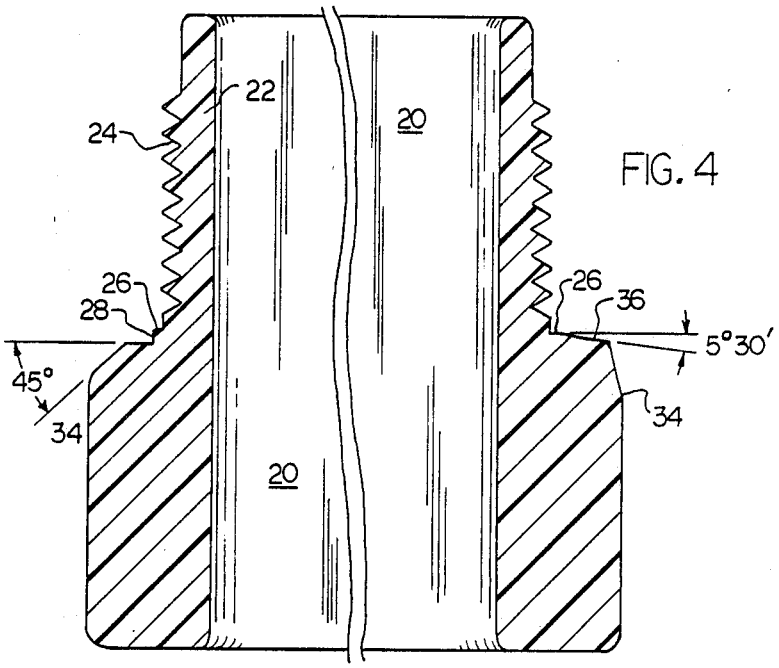
FIG. 4 is a greatly enlarged sectional view of the end cap removed from the cylindrical portion of the winding tube.

Looking at FIGS. 3 and 4, the relationship between the end cap 20 and hollow tube 10 is best shown as a result of the the enlarged illustrations. Hollow tube 10, which includes shell 12 and insert 50, terminates in an end wall 16. A tapered or chamfered surface 18 joins the outer periphery of hollow tube 10 and the end wall 16 to guide yarn being wrapper around hollow tube 10 in the are of the end portion thereof inwardly toward the peripheral grooves 40,42.

The end cap 20 includes an axially extending end or nose 22 of reduced wall thickness and having outer threads 24 around the periphery thereof which mate with and engage the inner threads 56 of insert 50. End cap 20', where used, has its own threaded portion 24'. The mating threads 56,24 form a means for releasably mounting the end cap 20 onto the hollow tube 10. Alternate mounting means might include snap fits, bayonet tabs, male and/or female tapered marginal portions tapered, and the like, it being understood that the mating threads 56,24 are representative thereof.

The embodiment illustrated in FIGS. 3 and 4 result in a latching or starting groove of the type used widely in current winding operations and having a lead-in portion 40 and a locking portion 42. Toward this end, immediately adjacent the base of threads 24 on end cap 20 is a radially extending peripheral rim 26, which forms a stop means against which the end wall 16 of the hollow tube 10 engages as the end cap is mounted on the hollow tube 10. The marginal extension 54 of insert 50 is longer than the nose 22 of the end cap 20, so that the end wall 16 of tube 10 will engage peripheral rim 26 prior to the time the terminal wall 23 of the end cap 20 engages the corresponding portion of hollow tube 10.

A shoulder 28 extends around approximately three-fourths of the periphery of the end cap 20 (approximately 270°) and separates the peripheral rim 26 from a second groove forming wall 30 which separation is substantially greater than the diameter of the yarn being wound thereon. A bevel surface 32 (approximately 45°) angles outwardly from the groove forming wall 30 toward the outer periphery of the end cap 20 to guide yarn into the groove between wall 30 and the end wall 16. Finally, a slight chamfer 34 connects the outer periphery of end cap 20 with the first bevel surface 32.

In the remaining one-fourth (approximately 90°) of the periphery of the end cap, the shoulder 28 and groove forming wall 30 are replaced by the slightly angled peripheral wall 36. Wall 36 does not extend radially, rather is tapered away from an imaginary radius by an angle of approximately 5° 30 min. Again the wall 36 is connected to the outer periphery of end cap 20 by a chamfered surface 34.

Thus formed, there is a peripheral groove means formed between the confronting walls of the hollow tube and the end cap which encircles the yarn carrier. The groove means includes first a relatively wide lead-in portion 40 which is formed by shoulder 28 and which extends approximately 270° around the periphery of the winding tube WT. Secondly, a relatively narrow locking portion 42 is formed between the end 16 of hollow tube 10 and the wall 36 of end cap 26. So arranged, the yarns of the transfer bunch are directed toward the lead-in groove 40 and into the locking groove 42 as the winding tube is rotated.

As can be easily seen from FIGS. 3 and 4, when the yarn package is emptied, yarn fibers and filaments tend to remain in the lead-in groove 40 and the locking groove 42. Such yarn ends cannot be vacuumed or stripped away in conventional, integrally formed paper tubes. However, the present construction allows the operator to unscrew the end cap slightly, whereupon the fibers and filaments are released and can be easily removed by suction or other stripping means.

Alternatively and particularly in situations in which lighter denier yarns are being run, the lead-in portion of the starting groove may be unnecessary. Where the starting groove is of constant crosssectional shape throughout, the configuration of such constant cross-sectional shape should be as illustrated by groove portion 42 of FIG. 3. Thus the end cap is formed as illustrated on the right-hand side of FIG. 4 with rim 26 and wall 36. The mating end of the hollow tube 10 should be substantially the mirror image of the wall formed on the end cap 20 by rim 26 and wall 36.

While a preferred embodiment of the invention has been described in detail hereinabove, various changes and modifications may come to mind which would fall within the scope of the present invention which is set forth in the accompanying claims, in which:

We claim:

1. A reusable high speed winding tube comprising:

(a) a hollow tube having an outer substantially cylindrical surface adapted to support multiple wraps of a fibrous or filamentary yarn thereon;

(b) an end cap having an outer cylindrical surface, means on said hollow tube and end cap for releasably mounting said end cap on at least one end of said hollow tube;

(c) a starting groove between said hollow tube an said end cap;

(d) said hollow tube including:

(i) a cylindrical shell of a prescribed length and an outer diameter compatible with conventional yarn carriers, having a wall thickness in the range of 0.062 inches and 0.200 inches, and being formed of a material selected from the group consisting of steel, aluminum, lightweight metallic alloys and a polymeric material reinforced with fibers selected from the group consisting of aramids, carbon, ceramic, glass and hybrids thereof;

(ii) at least one insert secured to the inner surface of the marginal end of said hollow tube adjacent said end cap;

(iii) said insert having fastening means associated therewith for receiving said end cap in secure assembled relation thereto;

(e) whereby said yarn carrier is reusable and capable of withstanding the stress imposed by winding speeds of 10,000 meters per minute and above and yet includes the same effective inner and outer diameter.

2. The reusable high speed winding tube according to claim 1 wherein said insert includes a cylindrical body portion of a prescribed thickness, a portion of the axial length of said body portion having a reduced thickness, the internal wall of said reduced thickness portion being threaded, and the inner surface of said main body portion having a diameter compatible with an being received by conventional winding equipment.

3. The reusable high speed winding tube according to claim 2 wherein said means for releasably mounting said end cap includes a threaded portion mating with and received by the threaded portion of said insert.

4. The reusable high speed winding tube according to claim 1 in which the confronting walls of said hollow tube and said end cap, when assembled, cooperate to define said starting groove therebetween.

5. The reusable high speed winding tube according to claim 1 wherein of said end cap is provided on each of said hollow tube.

6. The reusable high speed winding tube according to claim 4 wherein said peripheral starting groove comprises a lead-in portion and a locking portion, said lead-in portion extending approximately 207° around the periphery of said tube and said locking portion extends approximately 90° around the periphery of said tube.

7. The reusable high speed winding tube according to claim 6 wherein said lead-in portion is formed by a shoulder separating the confronting walls of said hollow tube and said end cap and said locking portion is formed by one of the abutting walls of said hollow tube and said end cap being tapered from an imaginary radius.

8. The reusable high speed winding tube according to claim 7 wherein said lead-in groove has a width greater than the diameter of the yarns being wound thereon.

9. The reusable high speed winding tube according to claim 4 wherein said starting groove includes a consistent cross-sectional configuration throughout.

* * * * *